United States Patent [19]

Pali

[11] Patent Number: 4,575,016

[45] Date of Patent: Mar. 11, 1986

[54] CONTINUOUS RIBBON FEED METHOD AND SYSTEM

[75] Inventor: Christopher Pali, Fort Wayne, Ind.

[73] Assignee: Essex Group, Inc., Fort Wayne, Ind.

[21] Appl. No.: 617,283

[22] Filed: Jun. 4, 1984

[51] Int. Cl.[4] ..... B65H 19/18; B65H 19/14

[52] U.S. Cl. ..... 242/58.1; 221/14; 242/58.2; 242/58.6; 242/79

[58] Field of Search ..... 242/58.1, 58.2, 58.3, 242/58.4, 58.5, 58.6, 79, 80, 58; 221/10, 14

[56] References Cited

U.S. PATENT DOCUMENTS

| | | | |
|---|---|---|---|
| 2,386,345 | 10/1945 | Roesen | 242/58 |
| 3,078,023 | 2/1963 | Hecker | 226/118 |
| 3,165,276 | 1/1965 | Stone et al. | 242/58.3 |
| 3,332,595 | 7/1967 | Wetzler | 226/119 |
| 3,547,739 | 12/1970 | Beute | 156/504 |
| 3,582,010 | 6/1971 | Whiteman | 242/58 |
| 3,645,463 | 2/1972 | Helm | 242/58.1 |
| 3,877,653 | 4/1975 | Foltyn | 242/79 X |
| 3,995,791 | 12/1976 | Schoppee | 242/58.1 |
| 4,236,626 | 12/1980 | Noe | 242/79 X |
| 4,278,489 | 7/1981 | Horsley | 242/58.6 X |
| 4,312,172 | 1/1982 | Fisher et al. | 221/14 X |
| 4,415,127 | 11/1983 | Seragnoli | 242/58.1 |
| 4,441,662 | 4/1984 | Seragnoli | 242/58 |

FOREIGN PATENT DOCUMENTS

| | | | |
|---|---|---|---|
| 491427 | 2/1976 | U.S.S.R. | 242/79 |

*Primary Examiner*—John Petrakes

*Attorney, Agent, or Firm*—Robert P. Hayter

[57] ABSTRACT

A method and apparatus for continuously feeding a ribbon to an end use are disclosed. The apparatus includes a conveyor means for supplying numerous rolls of material, a robot assembly for transferring the rolls of material from the conveyor means to a payoff assembly and a payoff assembly for unwinding the rolls of material. Additionally included is a storage means for storing paper such that the end use may be continuously supplied during those intervals when rolls are being changed.

8 Claims, 7 Drawing Figures

CONTINUOUS RIBBON FEED METHOD AND SYSTEM

BACKGROUND OF THE INVENTION

This invention relates to a method and apparatus for continuously feeding a ribbon to an end use such as a production line. More specifically the present invention is concerned with a system for supplying paper ribbon at extremely high rates of speed to end use on a continuous basis.

Prior art systems have been developed which allow paper to be supplied as a continuous ribbon or web to an end use. These prior art systems typically involve mounting a plurality of paper rolls on separate spindles and securing the end of one roll to the beginning of the next roll and thereafter continually mounting another roll to the then empty spindle. This may require, depending upon the speed of operation, a full time attendant at the machine to achieve this function.

The herein apparatus is designed to automatically provide paper to an end use at speeds in the range of 2,000–5,000 feet per minute. The system includes a conveyor assembly for supplying rolls of feedstock, a robot assembly for transferring paper rolls from the conveyor assembly to a paper payoff assembly. A paper payoff assembly for unrolling the roll of paper at a very high rate of speed and a ribbon feeder and accumulator assembly for storing up to thousands of feet of paper, such, that paper may be continuously supplied to the end use during paper roll changeover intervals.

The system as described provides for an overall arrangement allowing paper to be supplied at extremely high rates of speed to an end use without requiring any manual labor in the process. The conveyor assembly may be loaded on a periodic basis, such as once every eight hours or once per day, and thereafter the system acts to advance all the rolls of paper and to place them as desired on the payoff assembly. It is anticipated that at the rate of speeds being considered that a new paper roll will need to be mounted every six to fifteen minutes. Hence, the system must be capable of providing up to 240 paper rolls per day to the payoff assembly for unwinding.

SUMMARY OF THE INVENTION

It is an object of the present invention to provide a complete paper feed system for an end use such as a production line.

It is another object of the present invention to provide a method of completely automatically unwinding a plurality of paper rolls.

It is a further object of the present invention to provide robot apparatus in conjunction with the conveyor assembly for supplying paper rolls to a payoff assembly.

It is a yet further object of the present invention to provide a system having sufficient storage of unwound paper to allow for continuous feeding of paper during a time interval when the paper roll is being changed.

It is a yet further object of the present invention to provide a highly reliable, fully mechanized paper feed system.

It is a still further object of the present invention to provide a safe, economical, reliable, easy to maintain and service paper feed system and method.

Other objects will be apparent from the description to follow and the appended claims.

The above objects are achieved according to a preferred embodiment of the invention by the provision of apparatus for receiving rolls of ribbon material and for supplying a continuous ribbon to an end use. The apparatus includes conveyor means, storing numerous rolls of ribbon and transporting said rolls to an unloading position, ribbon payoff means including means for securing a roll of ribbon in a payoff position, means for unwinding the roll of ribbon at the desired speed and splicing means for securing the trail end of one roll of ribbon to the beginning end of the next roll of ribbon, and robot means interacting with the conveyor means and the ribbon payoff means to transfer a roll of ribbon from the conveyor means to the ribbon payoff means.

Additionally disclosed is a method of continuously supplying a ribbon of material to an end use from a plurality of rolls of ribbon. The method includes loading a conveyor means with a plurality of rolls of ribbon, conveying the rolls of ribbon to an unloading position of the conveyor means, unwinding a roll of ribbon at a controlled rate of speed on a ribbon payoff means, transferring rolls of ribbon from the unloading position of the conveyor and loading the rolls when appropriate on the ribbon payoff means and splicing the beginning end of the new roll of ribbon to the ribbon from the unwound roll of ribbon.

DESCRIPTION OF THE PREFERRED EMBODIMENT

Figure 1:
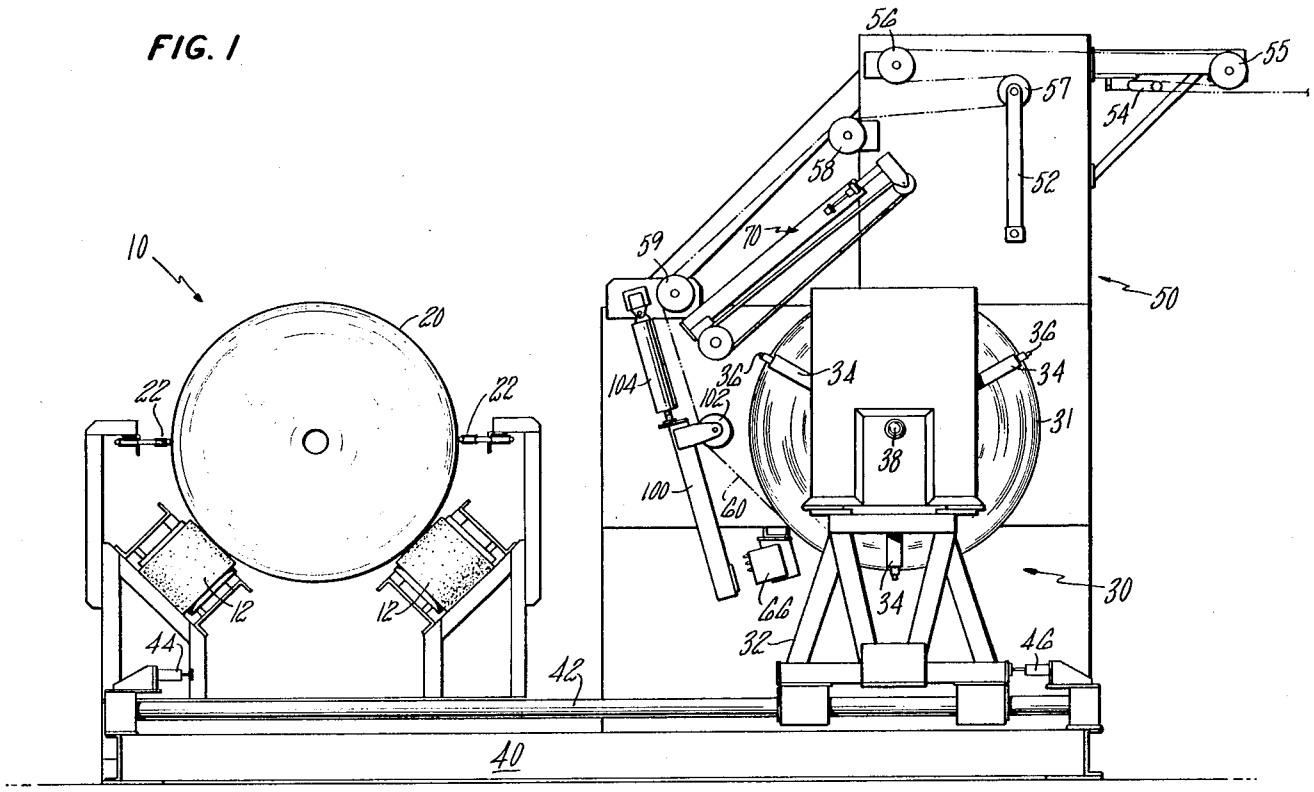
FIG. 1 is a front plan view of the conveyor assembly, robot assembly and paper payoff assembly.
Figure 2:
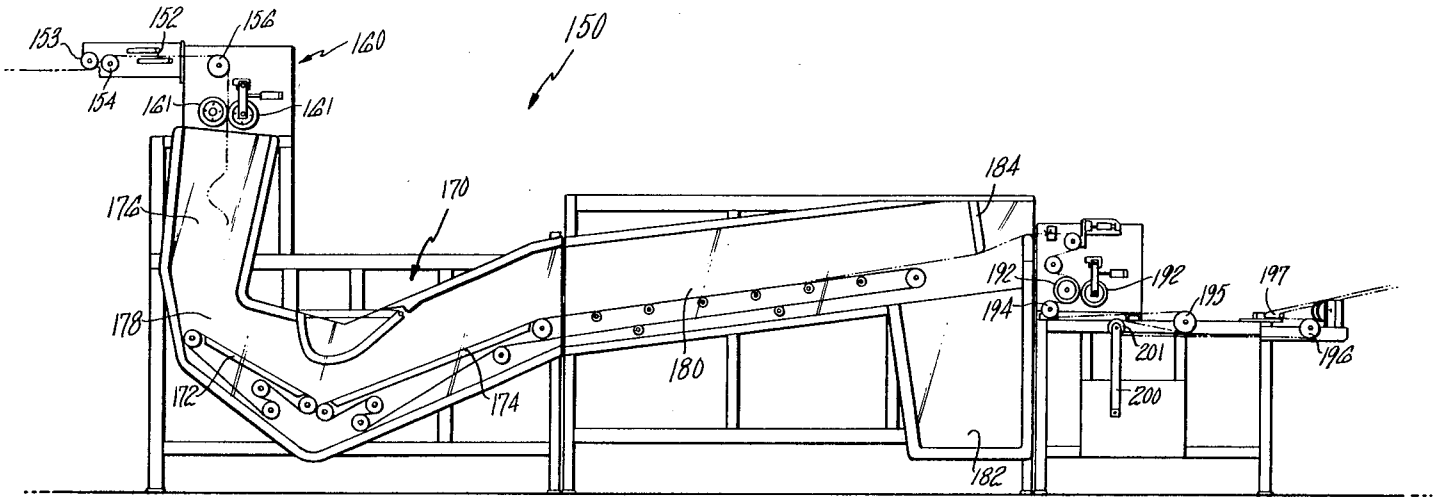
FIG. 2 is a front plan view of the ribbon feeder and accumulator assembly and feed-up assembly.
Figure 3:
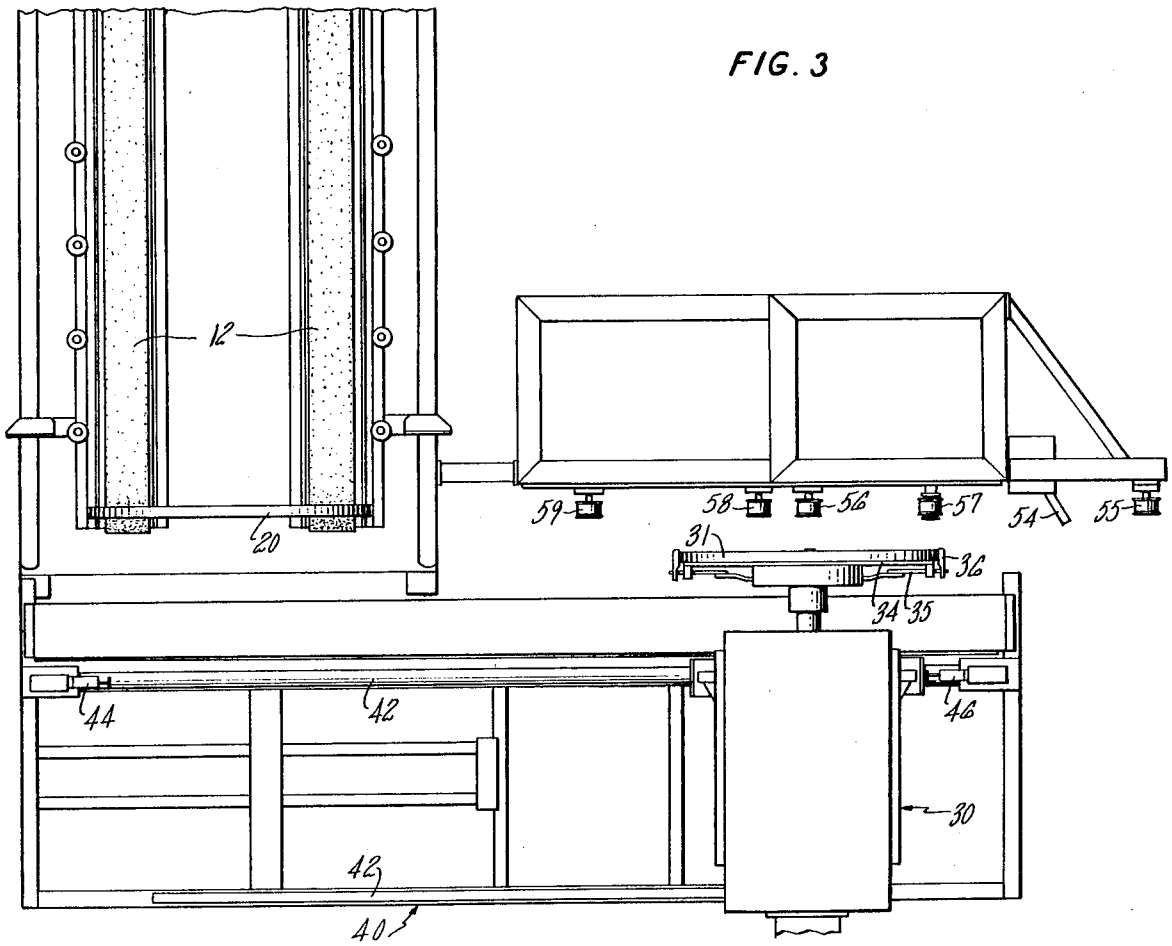
FIG. 3 is a top plan view of the conveyor assembly, robot assembly and paper payoff assembly.

Referring to FIGS. 1–3 there may be seen a front plan view and a partial top view of a complete ribbon feed system for supplying paper ribbon from large rolls of ribbon to an end use at a high rate of speed. It is anticipated that ribbon as required for a particular use may come in rolls up to three feet in diameter and may be of varying widths. The specific use for which the herein equipment was designed is to supply paper to a wire production facility. This paper is typically of a width between one and one-and-a-half inches. It is desirable to supply the paper at speeds in the 2,000–5,000 feet per minute range. This paper supply system could, of course, be used for other applications, with other ribbon materials and with rolls of stock of varying sizes.

Each paper roll of the dimensions mentioned contains approximately 17,000 lineal feet of paper. At the desired unwinding speeds an individual paper roll is completely consumed in 4–9 minutes. The equipment herein is designed to allow another roll to be mounted automatically and joined to the previous roll such that the wire production facility may operate continuously including without interruption when paper rolls are being changed. Absent such machinery it would be necessary to provide attendants for this machinery for the purpose of loading paper rolls.

FIG. 1 is front plan view of a conveyor assembly, a paper payoff assembly and a robot assembly. Conveyor assembly 10 consists of two parallel mounted conveyor belts 12 having a series of paper rolls 20 stacked vertically therebetween. The length of the conveyor belts depends upon the number of paper rolls desired to be mounted on the conveyors at one time. The length is theoretically unlimited. The conveyor assembly includes means to advance the conveyor belts to move paper rolls 20 forward to a position where robot assembly 30 may grasp and remove the roll from the conveyor belts. Position sensors 22 are shown located one on either side of the paper roll to indicate that the paper roll has been advanced to a pickup position. The conveyor belts are typically operated to advance the paper rolls until the position sensors are tripped by contact with the paper roll.

Robot assembly 30 is mounted on rails 42 for left-to-right motion as seen in FIG. 1. Position stops 44 and 46 are utilized to control the position of robot assembly 30. Robot assembly 30 includes arms 34 containing clamp jaw mechanisms for securing paper roll 31. A central shaft for allowing rotation of the entire paper roll is further provided. The robot assembly may traverse to the left, mechanically grasp and remove a paper roll from the conveyor assembly, and thereafter traverse to the right until aligned with the paper payoff assembly. The robot assembly then acts to position the paper roll on paper payoff assembly 50. Once the paper roll is on paper payoff assembly 50 paper ribbon 60 is directed over pulleys 102, 59, 58, 57, 56, and 55 serially. The ribbon then passes over angle bar 54 and continues to the ribbon feeder and accumulator assembly 150 of FIG. 2. Paper payoff assembly 50 further includes a paster arm assembly 100, glue applicator 66, drive belt assembly 70, and dancer arm 52. The paster arm assembly includes apparatus for holding and cutting the ribbon after a paper roll has been unwound. Glue applicator 66 is utilized to provide adhesive to the trail end of the consumed paper roll such that the trail end of the ribbon from the consumed paper roll may be connected to the beginning portion of the ribbon of the new roll mounted on the paper payoff assembly by the robot assembly.

Drive belt assembly 70 consists of a drive belt operated to rotate the paper roll at a desired speed to supply ribbon to the end use. The ribbon passes over pulley 57 which is mounted on dancer arm 52. The position of dancer arm 52 is used to control the speed of drive belt 70 for regulating the payoff rate of ribbon 60.

FIG. 3 is a top plan view of FIG. 1 showing the relative positioning between the various elements. It may be seen that conveyor assembly 20 includes conveyor belts 12 extending whatever distance desired. Paper roll 20 is shown at the end of the conveyor assembly.

Robot assembly 30 is shown mounted for left-to-right movement on rails 42 of machine frame 40. Position stops 44 and 46 are shown for appropriately positioning the robot assembly.

Robot assembly 30 is additionally shown holding paper roll 31 with clamp jaws 36. Clamp jaws 36 are connected to drivers 35 for manipulating the jaws radially inwardly and outwardly. Arm 34 is shown for securing the driver and clamp jaw for sliding motion relative thereto. Pulleys 56 through 59 of the paper payoff assembly are additionally shown to indicate the relative positioning therebetween. Paper roll 31 shown clamped in the robot assembly is in position to be mounted on a core latch chuck of the paper payoff assembly. The robot assembly will advance the paper roll toward the top of FIG. 3 to place it in on the core latch chuck and in alignment with the pulleys indicated on the payoff assembly.

FIG. 2 is a front plan view of a ribbon feeder and accumulator assembly 150. The ribbon feeder and accumulator assembly is utilized to store sufficient ribbon that during the time interval between the consumption of one paper roll and the mounting of a new paper roll by the robot assembly that the process to which the paper is supplied may continue to operate with paper being continuously supplied from the ribbon feeder and accumulator assembly. To supply paper for this interval when no paper is being unwound, it is necessary to store a sufficient quantity of paper that operation of the end use may continue. Under the circumstances described it might be appropriate to store from 1,000–5,000 lineal feet of paper ribbon in the feeder and accumulator assembly.

The ribbon feeder and accumulator assembly includes stacking box 170 having feed chute 176, stacking area 178 and storage area 180. Ribbon is supplied through pulleys 153 and 154, through static eliminator 152 and around pulley 156 to feed wheels 160. Feed wheels 160 direct the ribbon into the stacking area and include urethane tire-like portions for effectively stiffening the ribbon such that it is directed in a straight path resulting in the ribbon being folded in large loops in the stacking area. Stacks of ribbon from the stacking area are conducted by ramp conveyor belt 172 downwardly and to the right. Storage conveyor belt 174 then directs the stacks of ribbon into storage area 180. The pack lean reversing shoe 175 is positioned to create a resistance at the top portion of the folds such that as the folds of paper are switched from ramp conveyor belt 172 to storage conveyor belt 174 the direction of lean of the folds is reversed. Reversing the direction of lean of the paper in the storage area allows the paper to be removed from the storage area without pulling the paper from the bottom of the pack thereby reducing the force required to physically pull the paper from the storage area. Spill box 182 is utilized to store excess folds when inadvertently dumped thereinto. Fold stripper 184 acts to remove the folds from the paper.

Feed-up assembly 190 includes supply wheels 192 for supplying paper to the end use at the desired rate, pulleys 194, 195, 196, 197 and dancer 200 having pulley 210. The position of dancer 200 is sensed and thereafter used to regulate the supply wheels to control the rate of feed of paper ribbon to the end use. The remaining pulleys simply act to guide the paper through the feed-up assembly.

Figure 4:
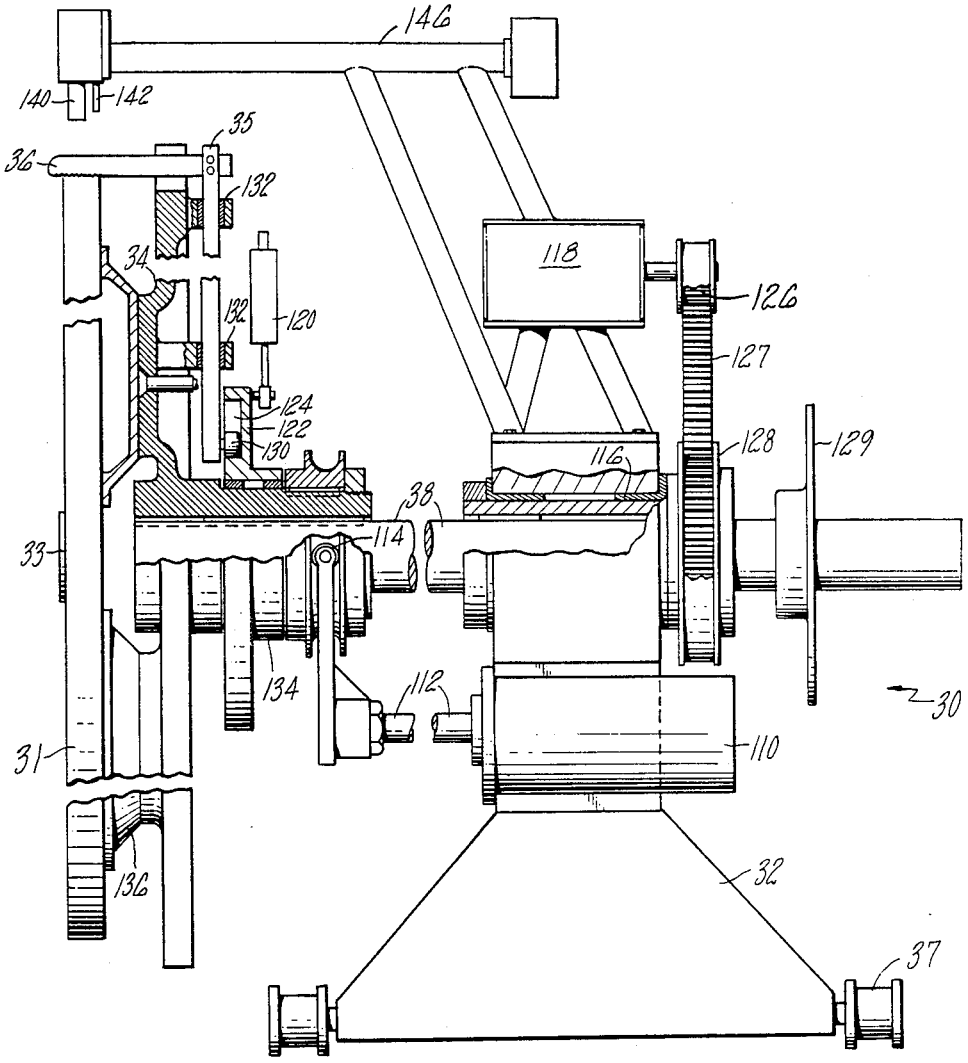
FIG. 4 is a partially sectional side view of the robot assembly.

FIG. 4 is a partially schematic, partially cutaway view of robot assembly 30. Paper roll 31 shown mounted on the left-hand side of the robot assembly and includes paper core 33. The paper roll is secured in position via clamp jaw 36 connected to clamp jaw driver 35. Arm 34 extends outwardly from spindle 134 and includes a slide guide 132 for securing the clamp jaw driver 35 for relative sliding displacement therewith. Adjustable spacers 136 are utilized to provide the desired spacing between the arm and the paper roll. The size of the spacer may be adjusted depending upon the width of the paper roll being utilized. Although only one arm and clamp jaw is specifically shown more than one, such as three, may actually be utilized.

Cam hub 122 is mounted on a portion of spindle 134 and is generally cylindrical in configuration. Cam hub 122 defines an inclined slot 124. Actuator 120 is provided for rotating the cam hub when it is desired to displace the clamp jaws either outwardly or inwardly. Cam follower 130 is an extension connected to clamp jaw driver 35 and extends into inclined slot 124 of the cam hub. Upon rotation of the cam hub, the cam follower follows the slot and acts to either displace the clamp jaw driver and attached clamp jaw either inwardly or outwardly to either engage or disengage the paper roll as desired.

The entire robot assembly is mounted on slide bearings 37 for left-to-right displacement as may be seen at FIG. 1. Frame 33 supports the robot assembly from the slide bearings 37.

Air cylinder 110 is provided having piston 112 slidably connected to yoke 114 which is attached to spindle 134. When it is desired to either secure a roll of paper from the conveyor belt or to place a roll of paper on the core latch of the paper payoff assembly the spindle is advanced to the desired position by displacing the spindle from the frame in the robot assembly. The air cylinder is actuated to drive piston 112 either to the left or to the right and yoke 114 acts to displace the spindle an equivalent distance.

Drive motor 118 is shown connected to drive gear 126 which is connected via belt 127 to driven gear 128 connected to drive shaft 38 of the spindle. Drive motor 118 acts to rotate the entire spindle to the desired position relative to either removing a paper roll from the conveyor belt or placing the paper roll in position on the paper payoff assembly. Drive shaft 138 is supported for rotational and sliding movement by bearing 116 within the frame of the robot assembly.

Additionally connected to the robot assembly and extending therefrom in any desired direction is detector frame 146. Detector frame 146 includes a light sensing detector 140 and a metal detector 142 mounted at the end thereof and positioned next to the paper roll. The light sensing detector is utilized to detect a predetermined printed mark placed on a paster tab securing the loose end of the paper roll in position. By sensing the position of this printed mark the paper roll may be oriented as desired when mounted on the paper payoff assembly. Metal detector 142 is utilized to determine the presence of a clamp jaw such that the combination of sensors may separate the detection of printed mark from the detection of the clamp jaw.

Figure 5:
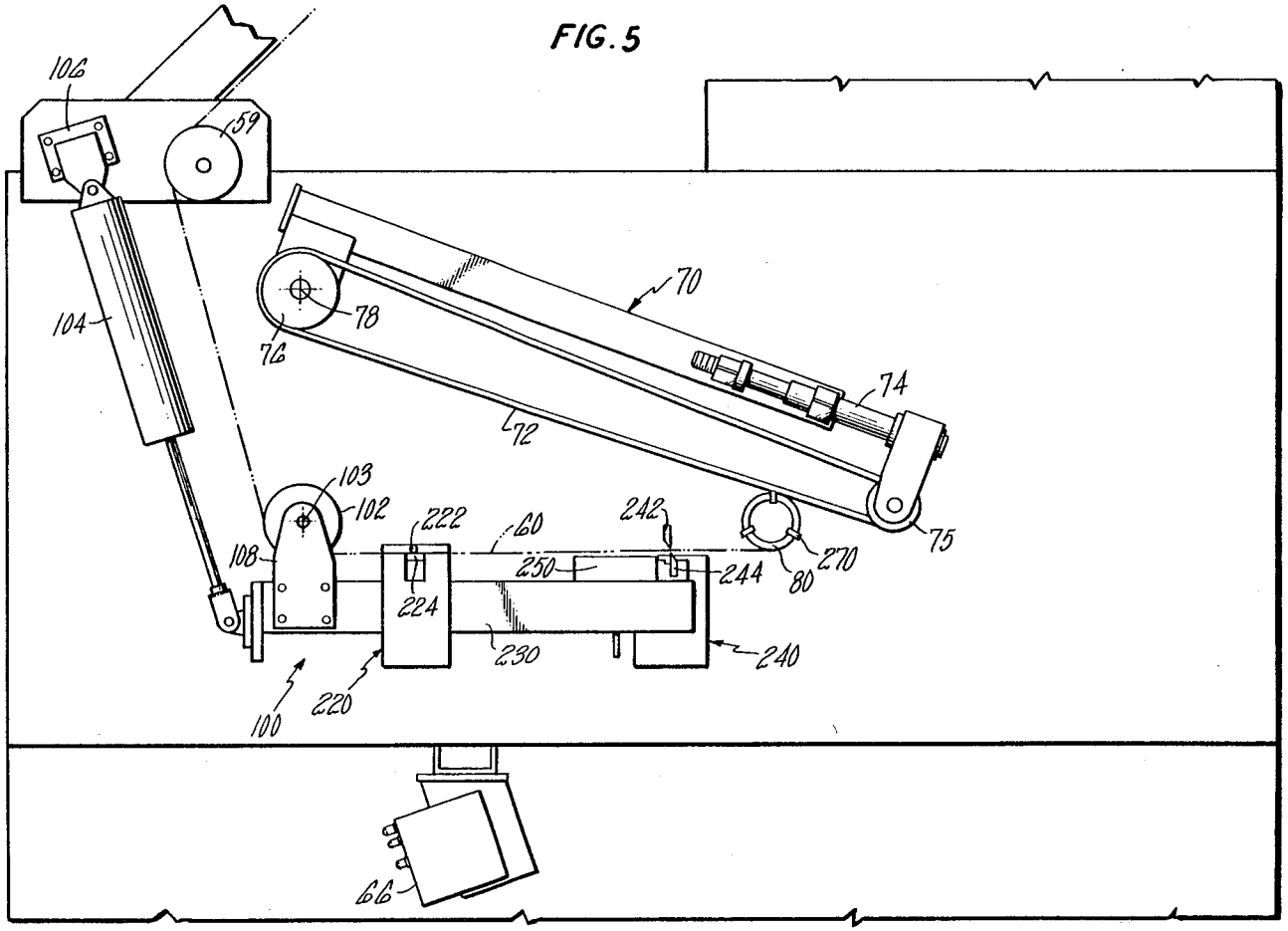
FIG. 5 is a side view of a portion of the payoff assembly.
Figure 6:
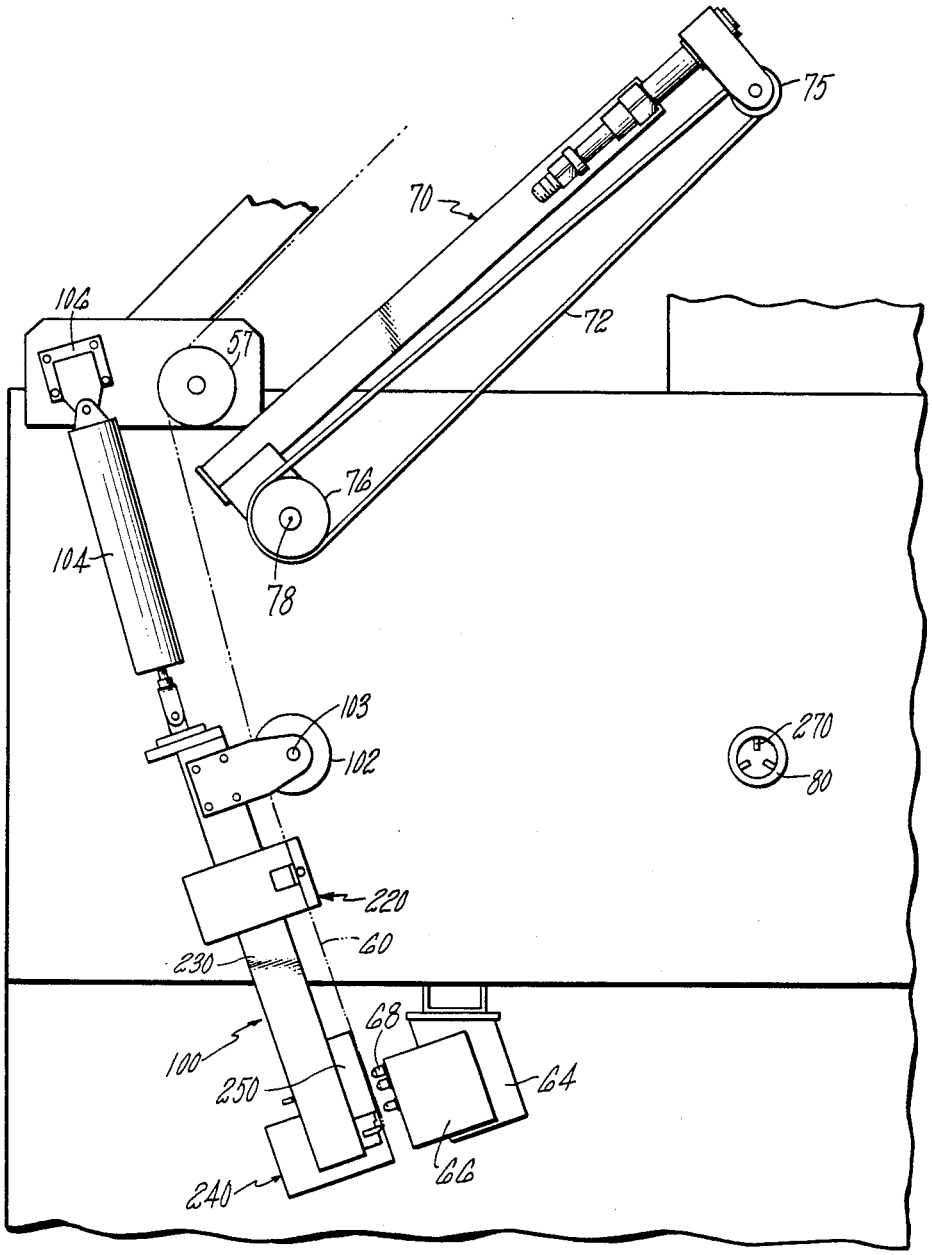
FIG. 6 is a side view of a portion of the payoff assembly.
Figure 7:
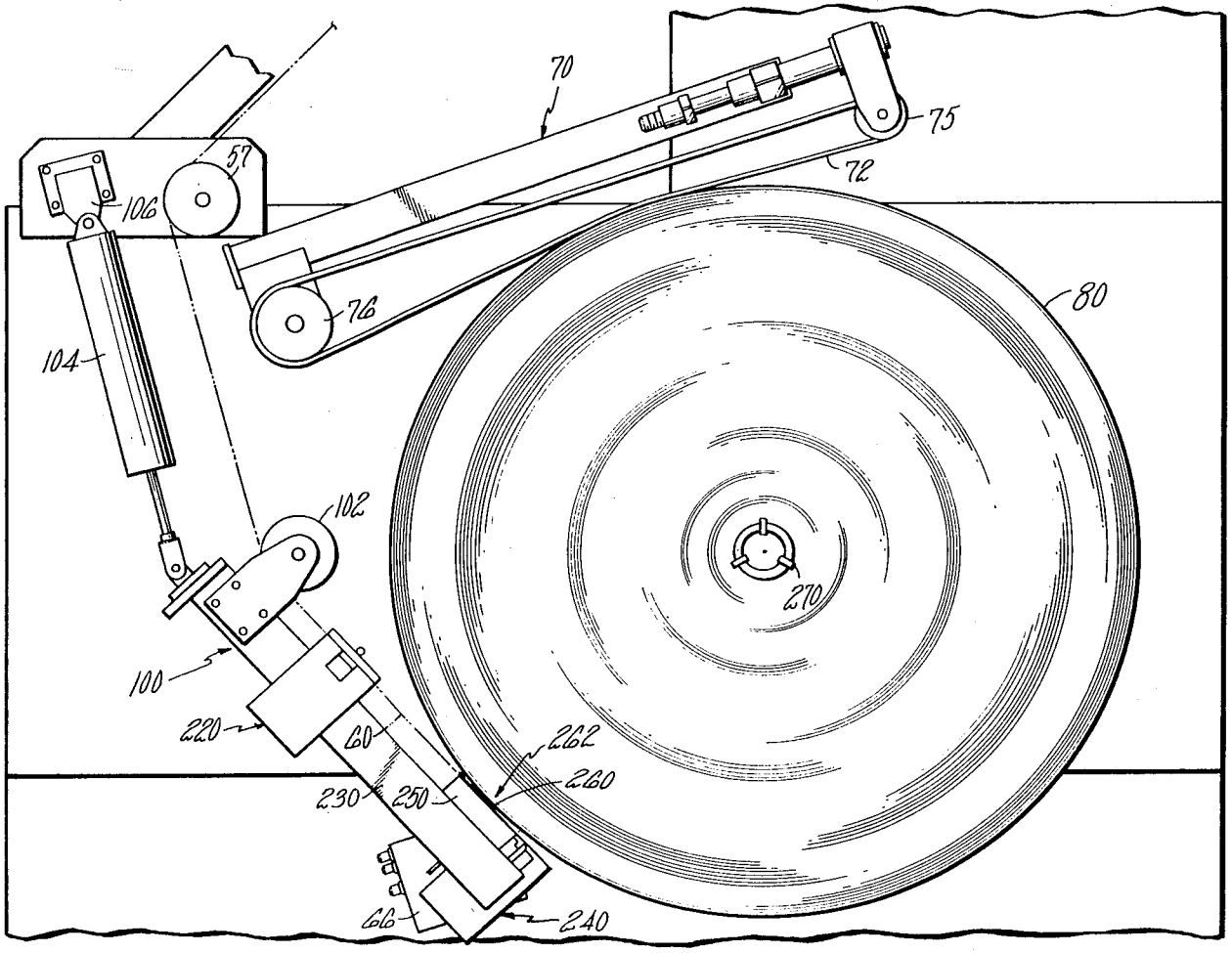
FIG. 7 is a side view of a portion of the payoff assembly.

FIGS. 5, 6 and 7 all disclose portions of the paper payoff assembly in different modes of operation. FIG. 1 is a plan view of the paper payoff assembly with the robot assembly located in front thereof showing a paper roll secured by the robot and, hidden from view, a separate paper roll being unwound. FIG. 5 shows a portion of the paper payoff assembly with the paper roll virtually depleted and the paster arm in position to sever the ribbon. The paper roll 80 is shown being secured through the center thereof by core latch gears 270. From paper roll 80 ribbon 60 extends to the left around pulley 102 and then upwardly around pulley 59. Drive belt assembly 70 having drive belt 72, support and tension arm 74 and pulleys 75 and 76 supported thereby provides a means for rotating the paper roll at the desired speed. A motor not shown drives pulley 76 at the desired speed based upon the position of dancer arm 52 to supply the ribbon of paper at the desired consumption rate. The entire drive belt assembly 70 pivots about pivot point 78 which is both the center point of pulley 76 and of the drive belt assembly such that the drive belt may rotate to be continually in contact with the paper roll.

Paster arm assembly 100 is shown in a raised position in FIG. 5. In this position it may be seen that ribbon clamp assembly 220 includes a clamp bar 222 positioned to secure ribbon 60 between the clamp bar and the clamp pad 224. Additionally vacuum cup 250 may be seen extending from paster arm assembly 100. This vacuum cup is made slightly arcuate to be configured to mate with the exterior surface of a full paper roll and includes on the surface thereof a neoprene type covering having a myriad of small holes through which a vacuum is drawn to secure the ribbon relative thereto.

Positioned on paster arm immediately downstream from the vacuum cup is ribbon knife assembly 240 including knife blades 242 and 244 which may be actuated to sever ribbon 60. Actuator 104 is shown connected between pivot support 106 and the main portion of the paster arm assembly. The paster arm assembly is connected via arm support 108 to pulley 102. Pivot point 103 is the pivot point for pulley 102 and also the pivot point of the main portion of the paster arm assembly. Hence, when the actuator is energized and extends, the paster arm rotates about pivot point 103 to swing upwardly to be in alignment with the ribbon such that the ribbon may be clamped, secured by the vacuum cup and cut by the knife. Glue applicator 66 is shown at the bottom of the drawing and is mounted to slide in and out when appropriate.

In the position as shown in FIG. 5 the paper roll has been used up and the drive belt assembly is deenergized to bring the paper roll to a stop. The paster arm actuator is energized to rotate the paster arm up and the ribbon clamp assembly and ribbon knife assembly are actuated such that the clamp assembly secures the ribbon in position maintaining the tension in the ribbon between the ribbon clamp assembly and the dancer arm, the vacuum cup acts to secure the end of the ribbon and the knife assembly cuts the ribbon between paper roll 80 and the portion of the ribbon secured by the vacuum cup. (For a more specific explanation of the ribbon clamp assembly and the knife assembly see U.S. Ser. No. 617,308 titled "An Assembly For Effecting Vertical And Rotational Motion" filed simultaneously herewith.)

Referring now to FIG. 6 it may be seen that paper roll 80 is released from the paper payoff assembly by withdrawing core latch gears 270 and the core latch chuck assembly through the core of the paper roll such that the paper roll drops to the floor.

Drive belt assembly 70 has been raised upwardly such that it is withdrawn from the area in which a new paper roll will be mounted. Paster arm actuator 104 has been energized to cause the paster arm to rotate downwardly. The ribbon remains clamped by ribbon clamp assembly 220 and the end thereof is held in position by vacuum cup 250. In this position glue applicator 66 secured by slidable support 64 is displaced outwardly to align with the end of the ribbon secured by the vacuum cup. Nozzles 68 connected to the glue applicator 66 act to guide the application of the adhesive to selected spots on the end of the ribbon as secured by the vacuum cup.

Referring now to FIG. 7 it may be seen that a new paper roll 80 has been placed in position by the robot assembly and that the core chuck assembly has been reinserted through the paper core and that chuck gears 270 extend outwardly securing the paper roll in position. It may additionally be seen that drive belt assembly 70 has been rotated downwardly to engage the top of the paper roll such that it is in position to start rotating the paper roll when desired.

Actuator 104 of the paster arm assembly 100 has been slightly extended such that the paster arm rotates upwardly until it contacts the exterior wrap of paper roll 80. Paster tab 260 is shown mounted on the exterior of the paper roll and includes an index line 262 which has been previously utilized by the robot assembly to place the paster tab in position to be secured to the trail end of the ribbon. The trail end of the ribbon remains secured by the vacuum cup and is contacted with the paster tab and the beginning end of the new roll such that the adhesive supplied by glue applicator 66 acts to secure the trail end of ribbon 60 to paster tab 260 and the beginning end of new paper roll 80. Clamp assembly 220 is deenergized such that the ribbon is no longer clamped and the vacuum cup is additionally deenergized. At this point the actuator of paster arm assembly acts to remove the paster arm assembly back to its original position as shown in FIG. 1. Operation of the paper payoff assembly may now be recommenced with the drive belt acting to rotate the paper roll at the desired speed and the dancer acting to control that speed. Tension of the ribbon between the dancer arm and the new paper roll has been maintained since the clamp assembly maintained tension until the trail end of the old ribbon was secured to the new paper roll. Upon energization of the drive belt assembly the paster tab separates with a portion of the paster tab and the new paper roll being secured to the tail end of the old paper roll such that a continuous paper ribbon is supplied to the end use. During this changeover interval when no paper is being supplied the paper stored in the feeder and accumulator is utilized.

During normal unwinding operation the paster arm is in position as shown in FIG. 1 for guiding ribbon from the paper roll. Upon the paper roll being depleted the paster arm advances to the position shown in FIG. 5 for clamping the ribbon and severing the ribbon. Once the ribbon is severed, the paster arm moves to the position shown in FIG. 6 to enable the application of adhesive to the ribbon and to allow the robot assembly to provide a new paper roll to the paper payoff assembly. The paster arm then moves to the position shown in FIG. 7 to join the old ribbon to the new ribbon. Thereafter the paster arm retracts to the position shown in FIG. 1 until the replacement cycle is needed again.

The invention has been described with reference to a particular embodiment. It will be understood by those skilled in the art that variations and modifications can be effected within the spirit and scope of the invention.

I claim:

1. Apparatus for receiving rolls of ribbon material having a hollow core and for supplying a continuous ribbon to an end use which comprises:

conveyor means for storing numerous rolls of ribbon and transporting said rolls to an unloading position;

ribbon payoff means including means for securing a roll of ribbon in a payoff position with a chuck inserted through the hollow core, means for unwinding the roll of ribbon at the desired speed and splicing means for securing the trail end of one roll of ribbon to the beginning end of the next roll of ribbon mounted to the payoff means on the same chuck;

robot means interacting with the conveyor means and the ribbon payoff means to secure a roll of ribbon material about is radially outward surface, to transfer the roll of ribbon from the conveyor means to the ribbon payoff means and to position the roll with the hollow core about the chuck of the payoff means; and wherein the conveyor means comprises two parallel endless conveyor belts between which the rolls are mounted, said conveyor belts acting to displace the rolls serially to the unloading position, means for powering said conveyor belts and position sensors mounted to detect the presence of a roll in the unloading position wherein the roll is properly oriented to be secured by the robot means, said position sensor being electrically connected to the means for powering said conveyor belts such that a belt is advanced if the corresponding position sensor fails to detect a roll in the desired position.

2. The apparatus as set forth in claim 1 and further comprising:

storage means for storing sufficient ribbon to continuously supply ribbon to the end use during those intervals when the ribbon payoff means is not unwinding a roll of ribbon.

3. The apparatus as set forth in claim 2 wherein the splicing means includes means for clamping the ribbon, means for cutting the ribbon, an adhesive applicator for supplying adhesive to an end of the ribbon and means for contacting the trail end of one roll of ribbon to the beginning end of the next roll of ribbon to secure them together.

4. A method of continuously supplying a ribbon of material to an end use from a plurality of rolls of ribbon which comprises the steps of:

(a) loading a conveyor means with a plurality of rolls of ribbon;

(b) conveying the rolls of ribbon to an unloading position of the conveyor means;

(c) sensing the rolls are located in the unloading position and oriented appropriately;

(d) unwinding a roll of ribbon at a controlled rate of speed on a ribbon payoff means;

(e) automatically unloading the remnants of the unwound roll of ribbon from the ribbon payoff means;

(f) transmitting rolls of ribbon from the unloading position of the conveyor means and loading the roll when appropriate onto a single ribbon payoff means;

(g) splicing the beginning end of the new roll of ribbon to the trail end of ribbon from the unwound roll of ribbon; and (h) repeating the above steps (b), (c), (d), (e), (f), and (g) to continuously supply a ribbon of material to an end use.

5. The method as set forth in claim 4 and further comprising the step of:

storing a sufficient quantity of ribbon to supply the end use during those time intervals when a roll of ribbon is not being unwound.

6. The method as set forth in claim 5 wherein the step of splicing includes the steps of:

sensing when a roll of ribbon is unwound;

clamping the ribbon to maintain tension in the ribbon;

cutting the ribbon; and securing the end of the ribbon from the unwound roll to the new roll.

7. The method as set forth in claim 6 and further comprising the steps of:

releasing the roll of ribbon from the payoff means after it has been unwound; and receiving and securing a new roll of ribbon to the payoff means from the step of transferring.

8. The method as set forth in claim 4 wherein the conveyor means comprises at least two conveyor belts and the step of conveying further comprises the steps of:

sensing when both sides of a roll of ribbon are in the desired unloading position; and independently energizing the conveyor belts to advance the rolls of paper except when a side of a roll of ribbon is in the desired unloading position.

* * * * *